US008376256B1

(12) United States Patent
Ferguson

(10) Patent No.: US 8,376,256 B1
(45) Date of Patent: Feb. 19, 2013

(54) PILL CRUSHING APPARATUS

(76) Inventor: Oscar Ferguson, Queens Jamaica, NY (US)

( * ) Notice: Subject to any disclaimer, the term of this patent is extended or adjusted under 35 U.S.C. 154(b) by 224 days.

(21) Appl. No.: 12/931,539

(22) Filed: Feb. 3, 2011

(51) Int. Cl.
*B02C 19/00* (2006.01)

(52) U.S. Cl. ..... 241/169.2; 241/DIG. 27

(58) Field of Classification Search ..... 241/DIG. 27, 241/169, 169.2
See application file for complete search history.

(56) References Cited

U.S. PATENT DOCUMENTS 5,863,001 A * 1/1999 Schulze ..... 241/30
5,915,637 A * 6/1999 Parsons ..... 241/168
6,059,209 A * 5/2000 Barson ..... 241/168
6,637,685 B1 * 10/2003 Kruger ..... 241/169.1
7,117,785 B2 * 10/2006 Walker, III ..... 100/126
7,296,762 B2 * 11/2007 Dorion ..... 241/169
7,413,137 B2 * 8/2008 Donovan ..... 241/168
8,292,205 B2 * 10/2012 Clouser et al. ..... 241/30

* cited by examiner

*Primary Examiner* — Faye Francis
(74) *Attorney, Agent, or Firm* — Emery L. Tracy

(57) ABSTRACT

A pill crushing apparatus for crushing tablets into powders is provided. The pill crushing apparatus including a mounting bracket having a rear wall, a first side wall, a second side wall, and a bottom wall mounted between the first side wall and the second side wall with the rear wall mountable to a vertical surface. A crushing arm is pivotally mounted between the first side wall and the second side wall of the mounting bracket. A plate mounting arm having a first end and a second end is provided with the first end connected to the crushing arm and the plate mounting arm extending in a generally downward direction from the crushing arm. A top crushing plate is mounted to the second end of the plate mounting arm. A bottom crushing plate is mounted between the first side wall and the second side wall of the mounting bracket. A tablet is positionable upon the bottom crushing plate. The top crushing plate is maneuverable against the bottom crushing plate such that the tablet is crushed between the top crushing plate and the bottom crushing plate.

16 Claims, 2 Drawing Sheets

PILL CRUSHING APPARATUS

BACKGROUND OF THE INVENTION

1. Field of the Invention

This invention relates generally to a pill crushing apparatus and, more particularly, the invention relates to a pill crushing apparatus for crushing tablets into powders enabling dosed medicaments to be converted into powders which are more easily ingested by some patients.

2. Description of the Prior Art

It has long been recognized that one of the preferred ways of administering medication is orally in tablet form. Medication in tablet form is the least expensive form in which to manufacture and package medication and is a preferred non-invasive delivery method. Further, compressed tablet form medication is the best form to avoid tampering.

There are several recognized problems associated with administering medication in tablet form. A principal known problem is that many children, geriatric patients, and mental patients have difficulty swallowing tablets. Additionally, a large number of people are subject to gag reflex response which will not permit them to swallow a tablet in solid form. A large number of bedridden patients or patients disposed in a reclined position are also not capable of swallowing tablets in solid form or in granular form. Persons or patients having to use nasal gastrological feeding tubes or other types of feeding tubes require that their medication be presented in a solution or liquid form. Medication has heretofore been taken in liquid form through a straw or in a powdered form when mixed with food. The above problems that exist with human patients also exist in the field of veterinary medicine.

An historical solution to the above mentioned problems of administering oral mediation in tablet form has been has been to grind the tablet through the use of a mortar and pestle. The use of a mortar and pestle, however, presents several problems. Use of a mortar and pestle is inefficient as each use requires cleaning and the crushing is relatively time intensive. Inadvertent spilling and crushed residue adhering to either the mortar or the pestle reduces the ultimate dosage transferred to the patient. Additionally, the manual grinding can cause the crushed tablets to produce inconsistent particle sizes as one individual may apply more pressure than another. It is also difficult to completely crush or fragment the tablets due to the considerable force required. Such a requirement of force often poses great difficulty for medical staff members, particularly when treating many patients.

SUMMARY

The present invention is a pill crushing apparatus for crushing tablets into powders. The pill crushing apparatus comprises a mounting bracket having a rear wall, a first side wall, a second side wall, and a bottom wall mounted between the first side wall and the second side wall with the rear wall mountable to a vertical surface. A crushing arm is pivotally mounted between the first side wall and the second side wall of the mounting bracket. A plate mounting arm having a first end and a second end is provided with the first end connected to the crushing arm and the plate mounting arm extending in a generally downward direction from the crushing arm. A top crushing plate is mounted to the second end of the plate mounting arm. A bottom crushing plate is mounted between the first side wall and the second side wall of the mounting bracket. A tablet is positionable upon the bottom crushing plate. The top crushing plate is maneuverable against the bottom crushing plate such that the tablet is crushed between the top crushing plate and the bottom crushing plate.

In addition, the present invention includes a method for crushing tablets into powders. The method comprises providing a mounting bracket having a rear wall, a first side wall, a second side wall, and a bottom wall, extending the first side wall from the rear wall, extending the second side wall from the rear wall, mounting the bottom wall between the first side wall and the second side wall, extending the bottom wall from the rear wall, mounting the rear wall to a vertical surface, pivotally mounting a crushing arm between the first side wall and the second side wall of the mounting bracket, connecting a plate mounting arm having a first end and a second end to the crushing arm, extending the plate mounting arm in a generally downward direction from the crushing arm, mounting a top crushing plate to the second end of the plate mounting arm, mounting a bottom crushing plate between the first side wall and the second side wall of the mounting bracket, positioning a tablet in a crushing bag, positioning the tablet/crushing bag upon the bottom crushing plate, and maneuvering the top crushing plate against the bottom crushing plate such that the tablet is crushed between the top crushing plate and the bottom crushing plate and within the crushing bag.

The present invention further includes a pill crushing apparatus for crushing tablets into powders. The pill crushing apparatus comprises a mounting bracket having a rear wall, a first side wall extending from the rear wall, a second side wall extending from the rear wall, and a bottom wall extending from the rear wall and mounted between the first side wall and the second side wall with the rear wall mountable to a vertical surface. A crushing arm is pivotally mounted between the first side wall and the second side wall of the mounting bracket. A plate mounting arm is provided having a first end and a second end with the first end connected to the crushing arm and the plate mounting arm extending in a generally downward direction from the crushing arm. A top crushing plate is mounted to the second end of the plate mounting arm. A bottom crushing plate is mounted between the first side wall and the second side wall of the mounting bracket with the bottom crushing plate mounted a predetermined distance above the bottom wall of the mounting bracket creating a bag storage compartment. A plurality of crushing bags is positionable within the bag storage compartment. A tablet is positionable within one of the crushing bags. The tablet/crushing bag is positionable upon the bottom crushing plate. The top crushing plate is maneuverable against the bottom crushing plate such that the tablet is crushed between the top crushing plate and the bottom crushing plate entirely within the crushing bag.

DETAILED DESCRIPTION OF THE PREFERRED EMBODIMENTS

Figure 1:
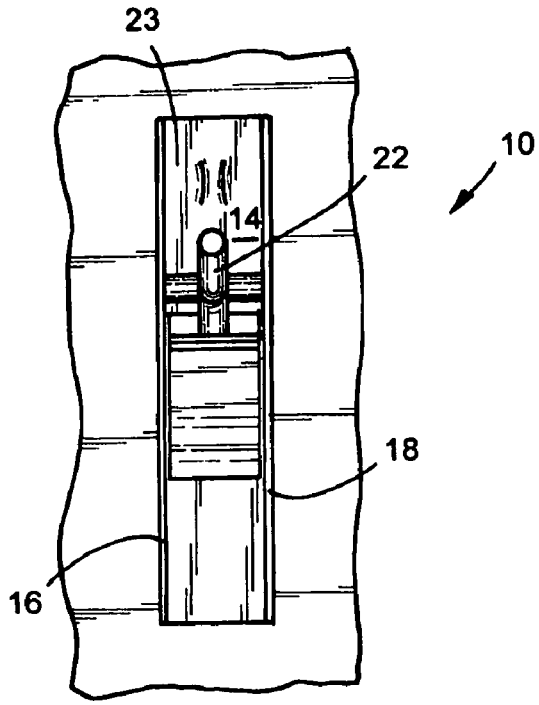
FIG. 1 is an elevational front view illustrating a pill crushing apparatus, constructed in accordance with the present invention.
Figure 2:
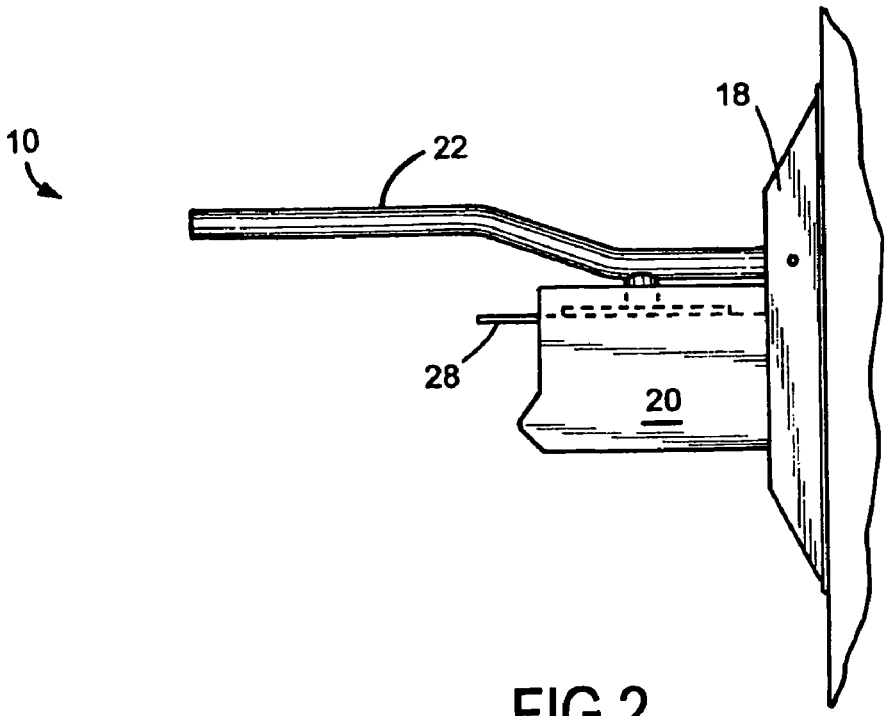
FIG. 2 is an elevational side view illustrating the pill crushing apparatus, constructed in accordance with the present invention.
Figure 3:
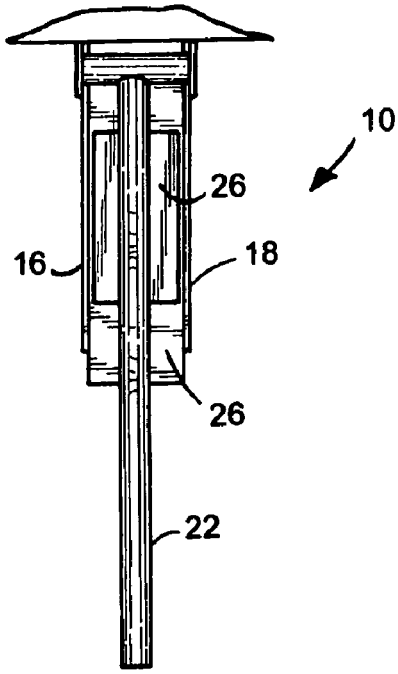
FIG. 3 is an top plan view illustrating the pill crushing apparatus, constructed in accordance with the present invention.
Figure 4:
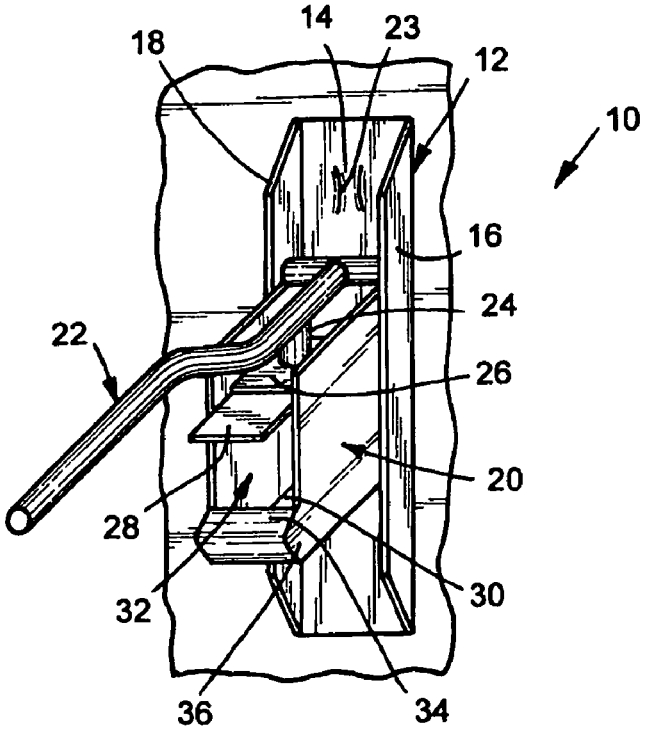
FIG. 4 is a perspective view illustrating the pill crushing apparatus, constructed in accordance with the present invention.

As illustrated in FIGS. 1-4, the present invention is a pill crushing apparatus, indicated generally at 10, for crushing tablets into powders enabling dosed medicaments to be converted into powders which are more easily ingested by some patients. The pill crushing apparatus 10 of the present invention solves the problems associated with administering medication in tablet form especially for children, geriatric patients, mental patients, persons subject to gag reflex response, bedridden patients, patients disposed in a reclined position, and patients having to use nasal gastrological feeding tubes or other types of feeding tubes.

The pill crushing apparatus 10 of the present invention includes a mounting bracket 12 having a rear wall 14, a first side wall 16 extending from the rear wall 14, a second side wall 18 extending from the rear wall 14, and a crushing device 20 extending from the rear wall 14 and mounted between the first side wall 16 and the second side wall 18. Preferably, the first side wall 16 and the second side wall 18 are spaced on each side of the rear wall 14 and extend substantially perpendicular from the rear wall 14. The rear wall 14 has a mounting mechanism, such as at least a pair of apertures for receiving screws or the like, allowing the mounting bracket 12 to be secured to a surface. Preferably, the mounting bracket 12 is secured to a vertical surface, as illustrated herein.

In addition, the pill crushing apparatus 10 of the present invention includes a crushing arm 22 pivotally mounted between the first side wall 16 and the second side wall 18 of the mounting bracket 12. The crushing arm 22 preferably extends substantially perpendicular from the rear wall 14, then angles in a generally upward direction, and then again extends substantially perpendicular from the rear wall 14. A catch 23 is formed on the rear wall 14 to hold the crushing arm 22 in an up position while not in use. The shape of the crushing arm 22 allows a person to achieve greater crushing strength and to position their hand away from the actual crushing operation. The actual operation of crushing the tablets will be described in further detail below.

The crushing arm 22 of the pill crushing apparatus 10 of the present invention includes a plate mounting arm 24 extending substantially perpendicular, in a generally downward direction, from the crushing arm 22. Preferably, the plate mounting arm 24 is positioned at the intersection of the first perpendicular portion and the angled portion of the crushing arm 22 although positioning the plate mounting arm 24 anywhere along the first perpendicular portion is within the scope of the present invention.

In addition, the crushing arm 22 of the pill crushing apparatus 10 of the present invention includes a planar, flat top crushing plate 26 mounted to an opposite end of the plate mounting arm 24. The top crushing plate 26 preferably has a width just slightly less than the width between the first side wall 16 and the second side wall 18 of the mounting bracket 12 allowing the top crushing plate 26 to move, but without contact, between the first side wall 16 and the second side wall 18 of the mounting bracket 12. Further, preferably, the top crushing plate 26 has a length equal to or less than the length of the first side wall 16 and the second side wall 18 of the mounting bracket 12 such that the top crushing plate 26 does not extend beyond the extent of the first side wall 16 and the second side wall 18 of the mounting bracket 12. Maintaining the extent of the top crushing plate 26 equal to or less than the length of the first side wall 16 and the second side wall 18 of the mounting plate 12 inhibits a person from getting their fingers caught during a crushing operation.

The pill crushing apparatus 10 of the present invention further includes a bottom crushing plate 28 mounted between the first side wall 16 and the second side wall 18 of the mounting bracket 12. The bottom crushing plate 28 is preferably a planar, flat plate mounted a predetermined distance above a bottom wall 30 of the crushing device 20 creating a space or bag storage compartment 32 for holding unused small crushing bags or other item, as desired by the user. Preferably, the bottom crushing plate 28 has a length less than or equal to the length of the first side wall 16 and the second side wall 18 of the mounting bracket 12 such that the bottom crushing plate 28 can extend to, but not beyond, the extent of the first side wall 16 and the second side wall 18 of the mounting bracket 12.

In a preferred embodiment of the pill crushing apparatus 10 of the present invention, the bottom wall 30 of the crushing device 20 has an extension portion 34 angling in a general direction upward and extending beyond the extent of the first side wall 16 and the second side wall 18 of the mounting bracket 12. The first side wall 16 and the second side wall 18 of the mounting bracket 12 have a flange 36 extending outward to meet the extension portion 34 of the bottom wall 30 of the crushing device 20. The angled extension portion 34 and the flange 36 further function to maintain the crushing bags within the bag storage compartment 32 and allow a person to more easily grasp a crushing bag from therewithin, when desired.

Preferably, the components of the pill crushing apparatus 10 of the present invention are constructed from a stainless steel material although constructing the components from other materials is within the scope of the present invention. In addition, preferably, the connections between the components are accomplished by welding although connecting the components in a different manner is within the scope of the present invention.

The manner of use of the pill crushing apparatus 10 of the present invention will now be described. It will be understood by those skilled in the art that the manner of use of the pill crushing apparatus 10 described herein is merely one method of use and other methods of use of the pill crushing apparatus 10 are within the scope of the present invention.

Application and use of the pill crushing apparatus 10 of the present invention is simple and straightforward. The user utilizes the pill crushing apparatus 10 to crush tablets into powders enabling dosed medicaments to be converted into powders which are more easily ingested by some patients. First, the user removes a crushing bag from the bag storage compartment 32 and places the required dose of tablets therein. Next, the user positions the tablet-containing crushing bag on the bottom crushing plate 28 ensuring that the tablet is approximately centered on the bottom crushing plate 28. Utilizing the crushing arm 22, the user causes the top crushing plate 26 to be moved in a generally downward direction toward the tablet resting within the crushing bag on the bottom crushing plate 28. As the top crushing plate 26 encounters the tablet, the user exerts the necessary downward force to cause the tablet to be crushed into a powder. The user next maneuvers the crushing handle 22 in a generally upward direction causing the top crushing plate 26 to be lifted off of the bottom crushing plate 28. The user can now remove the tablet-containing crushing bag from the bottom crushing plate 28. The powdered contents of the crushing bag can now be removed and placed in a desired drink or food for consumption by the patient.

The pill crushing apparatus 10 of the present invention offers users a number of significant benefits and advantages. Foremost, the pill crushing apparatus 10 provides users a simple and efficient means of crushing tablets into powders thereby enabling medication to be powdered for easier ingesting by patients. Users will appreciate that the pill crushing apparatus 10 is easily mounted to any vertical surface in any desired location. In fact, the pill crushing apparatus 10 can be mounted in a position out of reach to children thereby inhibiting children from gaining access to the pill crushing apparatus 10. In addition, by providing a handy, convenient bag storage compartment, a user will always have access to a crushing bag for placement of the tablets. Use of the crushing bag keeps the entire medical dose intact for consumption by the patient and maintains the pill crushing apparatus 10 in a clean and tidy condition. No chance of medication being mixed together from the same or different users.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A pill crushing apparatus for crushing tablets into powders, the pill crushing apparatus comprising:

a mounting bracket having a rear wall, a first side wall extending from the rear wall, a second side wall extending from the rear wall, and a bottom wall extending from the rear wall and mounted between the first side wall and the second side wall, the rear wall mountable to a vertical surface;

a crushing arm pivotally mounted between the first side wall and the second side wall of the mounting bracket;

a plate mounting arm having a first end and a second end, the first end connected to the crushing arm, the plate mounting arm extending in a generally downward direction from the crushing arm;

a top crushing plate mounted to the second end of the plate mounting arm; and a bottom crushing plate mounted between the first side wall and the second side wall of the mounting bracket;

wherein a tablet is positionable upon the bottom crushing plate; and wherein the top crushing plate is maneuverable against the bottom crushing plate such that the tablet is crushed between the top crushing plate and the bottom crushing plate.

2. The pill crushing apparatus of claim 1 wherein the first side wall and the second side wall are spaced on each side of the rear wall and extend substantially perpendicular from the rear wall and wherein the bottom wall is substantially perpendicular from the rear wall and the first side wall and the second side wall.

3. The pill crushing apparatus of claim 1 wherein the rear wall has a deformable catch for releasably securing the crushing arm against the rear wall.

4. The pill crushing apparatus of claim 1 wherein the crushing arm has a first portion extending substantially perpendicular from the rear wall, a second portion angled in a generally upward direction, and a third portion extending substantially perpendicular from the rear wall.

5. The pill crushing apparatus of claim 4 wherein the plate mounting arm is positioned at the intersection of a first perpendicular portion and an angled portion of the crushing arm.

6. The pill crushing apparatus of claim 1 wherein the top crushing plate has a width slightly less than the width between the first side wall and the second side wall of the mounting bracket allowing the top crushing plate to move, but without contact, between the first side wall and the second side wall of the mounting bracket.

7. The pill crushing apparatus of claim 1 wherein the top crushing plate has a length equal to or less than the length of the first side wall and the second side wall of the mounting bracket such that the top crushing plate does not extend beyond the extent of the first side wall and the second side wall of the mounting bracket.

8. The pill crushing apparatus of claim 1 wherein the bottom crushing plate is mounted a predetermined distance above the bottom wall of the mounting bracket creating a bag storage compartment, and further comprising:

a plurality of crushing bags positionable within the bag storage compartment;

wherein a tablet is positionable within one of the crushing bags prior to the tablet being positioned on the bottom crushing plate.

9. The pill crushing apparatus of claim 1 wherein the bottom crushing plate has a length less than or equal to the length of the first side wall and the second side wall of the mounting bracket such that the top crushing plate can extend to, but not beyond, the extent of the first side wall and the second side wall of the mounting bracket.

10. The pill crushing apparatus of claim 1 wherein the bottom wall of the mounting bracket has an extension portion angles in a general direction upward and extends beyond the extent of the first side wall and the second side wall of the mounting bracket and wherein the first side wall and the second side wall of the mounting bracket have a flange extending outward to meet the extension portion of the bottom wall of the mounting bracket.

11. A pill crushing apparatus for crushing tablets into powders, the pill crushing apparatus comprising:

a mounting bracket having a rear wall, a first side wall extending from the rear wall, a second side wall extending from the rear wall, and a bottom wall extending from the rear wall and mounted between the first side wall and the second side wall, the rear wall mountable to a vertical surface;

a crushing arm pivotally mounted between the first side wall and the second side wall of the mounting bracket;

a plate mounting arm having a first end and a second end, the first end connected to the crushing arm, the plate mounting arm extending in a generally downward direction from the crushing arm;

a top crushing plate mounted to the second end of the plate mounting arm;

a bottom crushing plate mounted between the first side wall and the second side wall of the mounting bracket, the bottom crushing plate mounted a predetermined distance above the bottom wall of the mounting bracket creating a bag storage compartment; and a plurality of crushing bags positionable within the bag storage compartment;

wherein a tablet is positionable within one of the crushing bags;

wherein the tablet/crushing bag is positionable upon the bottom crushing plate; and wherein the top crushing plate is maneuverable against the bottom crushing plate such that the tablet is crushed between the top crushing plate and the bottom crushing plate entirely within the crushing bag.

12. The pill crushing apparatus of claim 11 wherein the rear wall has a deformable catch for releasably securing the crushing arm against the rear wall.

13. The pill crushing apparatus of claim 11 wherein the crushing arm has a first portion extending substantially perpendicular from the rear wall, a second portion angled in a generally upward direction, and a third portion extending substantially perpendicular from the rear wall.

14. The pill crushing apparatus of claim 13 wherein the plate mounting arm is positioned at the intersection of a first perpendicular portion and an angled portion of the crushing arm.

15. The pill crushing apparatus of claim 11 wherein the bottom crushing plate has a length less than or equal to the length of the first side wall and the second side wall of the mounting bracket such that the top crushing plate can extend to, but not beyond, the extent of the first side wall and the second side wall of the mounting bracket.

16. The pill crushing apparatus of claim 13 wherein the bottom wall of the mounting bracket has an extension portion angles in a general direction upward and extends beyond the extent of the first side wall and the second side wall of the mounting bracket and wherein the first side wall and the second side wall of the mounting bracket have a flange extending outward to meet the extension portion of the bottom wall of the mounting bracket.

* * * * *